US011965516B1

(12) United States Patent
Schwarz

(10) Patent No.: US 11,965,516 B1
(45) Date of Patent: Apr. 23, 2024

(54) COMPRESSOR SYSTEM WITH REMOTE-MOUNTED RECIRCULATION VALVE

(71) Applicant: GM GLOBAL TECHNOLOGY OPERATIONS LLC, Detroit, MI (US)

(72) Inventor: Jordan Bucklew Schwarz, Oxford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 18/341,389

(22) Filed: Jun. 26, 2023

(51) Int. Cl.

| | |
|---|---|
| ***F04D 29/42*** | (2006.01) |
| ***F04D 17/10*** | (2006.01) |
| ***F04D 27/02*** | (2006.01) |
| ***F04D 29/58*** | (2006.01) |

(52) U.S. Cl.
CPC ..... *F04D 17/10* (2013.01); *F04D 27/0215* (2013.01); *F04D 29/4213* (2013.01); *F04D 29/584* (2013.01)

(58) Field of Classification Search
CPC .... F04D 29/4213; F04D 27/02; F04D 27/023; F04D 27/0238; F04D 27/0207; F04D 27/0215; F02B 37/16
See application file for complete search history.

(56) References Cited

U.S. PATENT DOCUMENTS

| | | | | |
|---|---|---|---|---|
| 2,656,096 | A * | 10/1953 | Schwarz | F04D 29/684 417/323 |
| 5,173,021 | A * | 12/1992 | Grainger | F02B 37/16 181/252 |
| 7,010,916 | B2 * | 3/2006 | Sumser | F01D 25/14 417/406 |
| 8,287,232 | B2 * | 10/2012 | Gu | F04D 27/0215 415/57.1 |
| 8,287,233 | B2 * | 10/2012 | Chen | F04D 29/4213 415/206 |
| 9,528,431 | B2 * | 12/2016 | Palko | F04D 29/4206 |
| 10,738,795 | B2 * | 8/2020 | Karwat | F04D 25/024 |
| 11,378,095 | B2 * | 7/2022 | Hayashi | F04D 29/4213 |

OTHER PUBLICATIONS

"High temperature compounds", Erico Spini, published Nov. 2012 (Year: 2012).*

* cited by examiner

*Primary Examiner* — Justin D Seabe

(57) ABSTRACT

A compressor system includes a compressor housing including an inlet opening and a diffuser outlet, the compressor housing includes a first recirculation passage extending from the diffuser outlet to a mounting face of the compressor housing. The compressor housing defines a cavity that receives a compressor wheel. An inlet adapter is mounted to the mounting face of the compressor housing and the inlet adapter includes a second recirculation passage in communication with the first recirculation passage in the compressor housing and with a compressor air inlet passage of the inlet adapter. A recirculation valve is mounted to the inlet adapter and is disposed in communication with the second recirculation passage for providing a selective connection of the first recirculation passage to the compressor air inlet passage.

17 Claims, 1 Drawing Sheet

COMPRESSOR SYSTEM WITH REMOTE-MOUNTED RECIRCULATION VALVE

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to a compressor system with a remote-mounted recirculation valve.

Compressor recirculation valves (CRVs) are used on turbocharged applications for surge mitigation, anti-icing, and driving exhaust gas recirculation flow. Available valves are limited in the range of application temperature due to sealing and electronic component limits. Highly boosted engine applications exceed the limits of currently available valve designs.

SUMMARY

The compressor recirculation valve is shifted from the typical mounting location on the compressor outlet to the compressor inlet. This improves the thermal capability of the valve by moving it to a cooler location on the compressor housing or inlet duct. Additionally, NVH noise is mitigated by shortening the length of the low-pressure section of the recirculation channel. When a blow-down event occurs, the pressure pulse generated by the CRV reaches the compressor inlet duct immediately and dissipates. By contrast, the current industry standard approach causes the pressure pulse to travel through a discharge channel at high velocity, creating audible noise when the valve opens under pressure.

The specified CRV mounting location on the compressor inlet duct reduces heat transfer from conduction by locating the CRV in a component adjacent to the compressor housing, with a thermal break provided between adjoining components. Additionally, the remote location of the valve reduces convective heating of the valve by the high-temperature, high-pressure air flow path present at the outlet of the compressor.

According to an aspect of the present disclosure, a compressor system includes a compressor housing including an inlet opening and a diffuser outlet, the compressor housing includes a first recirculation passage extending from the diffuser outlet to a mounting face of the compressor housing. The compressor housing defines a cavity that receives a compressor wheel. An inlet adapter is mounted to the mounting face of the compressor housing and the inlet adapter includes a second recirculation passage in communication with the first recirculation passage in the compressor housing and with a compressor air inlet passage of the inlet adapter. A recirculation valve is mounted to the inlet adapter and is disposed in communication with the second recirculation passage for providing a selective connection of the first recirculation passage to the compressor air inlet passage.

According to a further aspect, the compressor housing includes a coolant passage disposed between the diffuser and the recirculation valve.

According to a further aspect, the compressor housing includes a coolant passage disposed between the diffuser and the inlet adapter.

According to a further aspect, the inlet adapter is made from a material of low thermal conductivity, for example plastic.

According to a further aspect, the plastic material is a Nylon.

According to a further aspect, the first recirculation passage is defined by a bore in the compressor housing extending directly from the diffuser to an exterior face of the compressor housing.

According to a further aspect, the second recirculation passage extends from a mounting face of the inlet adapter to a surface of the compressor air inlet passage.

According to a further aspect, the gas recirculation valve is mounted to an exterior of the inlet adapter and in communication with an intermediate portion of the second recirculation passage.

According to yet another aspect of the present disclosure, a compressor system includes a compressor housing including an inlet opening and a diffuser outlet that communicate with a cavity. The compressor housing includes a first recirculation passage extending from the diffuser outlet. A compressor wheel is disposed in the cavity. An inlet adapter is made from a plastic material and is mounted to the inlet of the compressor housing. The inlet adapter includes a second recirculation passage in communication with the first recirculation passage in the compressor housing and with a compressor air inlet passage of the inlet adapter. A recirculation valve mounted to the inlet adapter and disposed in the second recirculation passage for providing a selective connection of the first recirculation passage to the compressor air inlet passage.

According to a further aspect of the present disclosure, a compressor system includes a compressor housing including an inlet opening and a diffuser outlet, the compressor housing including a first recirculation passage extending from the diffuser outlet. The compressor housing defining a cavity with a compressor wheel disposed in the cavity. An inlet adapter is mounted to the inlet of the compressor housing. The inlet adapter includes a second recirculation passage in communication with the first recirculation passage in the compressor housing and with a compressor air inlet passage of the inlet adapter. The compressor housing includes a coolant passage disposed between the diffuser outlet and the inlet adapter. A recirculation valve is mounted to the inlet adapter and disposed in the second recirculation passage for providing a selective connection of the first recirculation passage to the compressor air inlet passage.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
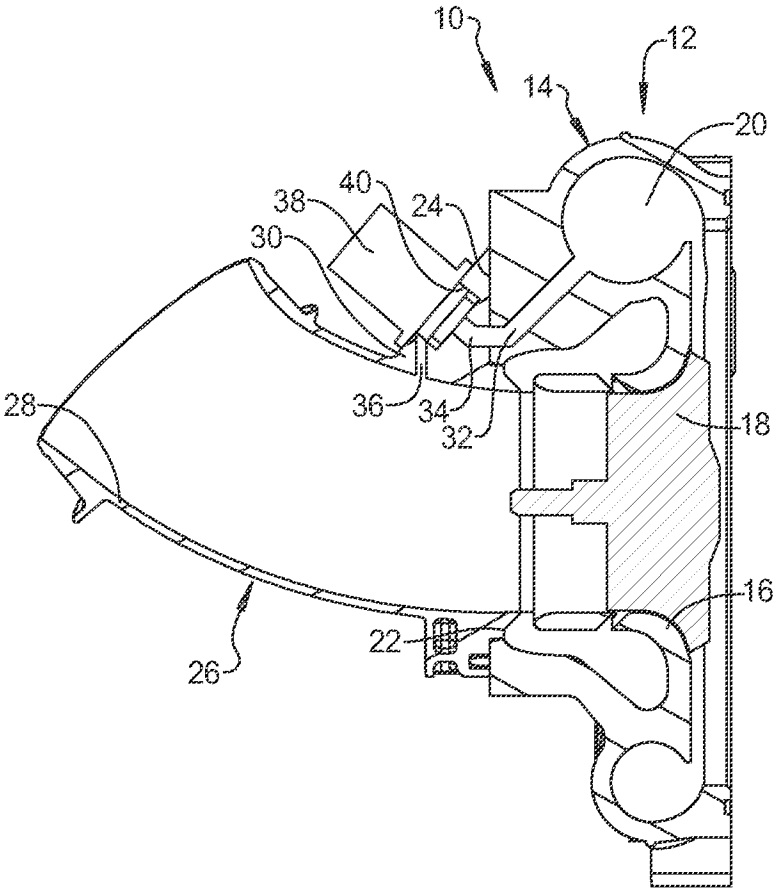
FIG. 1 is a cross-sectional view of a compressor section of turbocharger according to the principles of the present disclosure.

With reference to FIG. 1, a compressor section 10 of a turbocharger 12 will be described. The compressor section 10 includes a compressor housing 14 that defines a cavity 16 that receives a compressor wheel 18. The compressor housing 14 further includes a diffuser outlet passage 20 in communication with the cavity 16. The diffuser outlet passage 20 can surround the cavity 16 and includes an outlet opening that can be connected to an engine air inlet so that the compressor section 10 can provide compressed air to the engine. The compressor housing 14 includes an inlet opening 22 to the cavity 16. The inlet opening 22 is surrounded by a mounting face 24 of the compressor housing 14.

An inlet adapter 26 is mounted to the mounting face 24 of the compressor housing 14. The inlet adapter 26 includes a tubular passage 28 for directing air to the inlet opening 22 to the compressor housing 14. A mounting flange portion 30 surrounds the tubular passage 28 for mounting to the mounting face 24 of the compressor housing 14.

According to the principles of the present disclosure, the compressor housing 14 can include a first recirculation gas passage 32 that can extend from the diffuser outlet passage 20 to the mounting face 24 of the compressor housing 14. The inlet adapter 26 further includes a second recirculation gas passage 34 in the mounting flange portion 30 that communicates with the first recirculation passage 32 and with an outlet opening 36 that opens into an interior of the tubular passage 28 of the inlet adapter 26. A recirculation valve 38 is mounted to the mounting flange portion 30 inlet adapter 26 through an opening 40 that communicates with the second recirculation passage 34. The recirculation valve 38 is capable of opening and closing the passage through the second recirculation passage 34 and a provides a selective connection of the first recirculation passage 32 to the tubular passage 28 of the inlet adapter 26.

The present disclosure expands a range of compressor recirculation valve (CRV) operation using a CRV 38 mounted to the compressor inlet ducting 26. The compressor inlet adapter 26 features a mounting flange portion 30 located near the compressor flow path inlet for the recirculation valve 38, as well as a passage from the high pressure outlet of the compressor diffuser passage 20 back to the inlet of the recirculation valve 38. The compressor recirculation valve 38 is located a sufficient distance from the compressor housing 14 to ensure that material temperatures seen by the compressor recirculation valve 38 are lower and within the operable range of the compressor recirculation valve 38. The inlet adapter 26 in which the compressor recirculation valve 38 is installed can made from a plastic material with low thermal conductivity, such as Nylon PA66-GF35.

Figure 2:
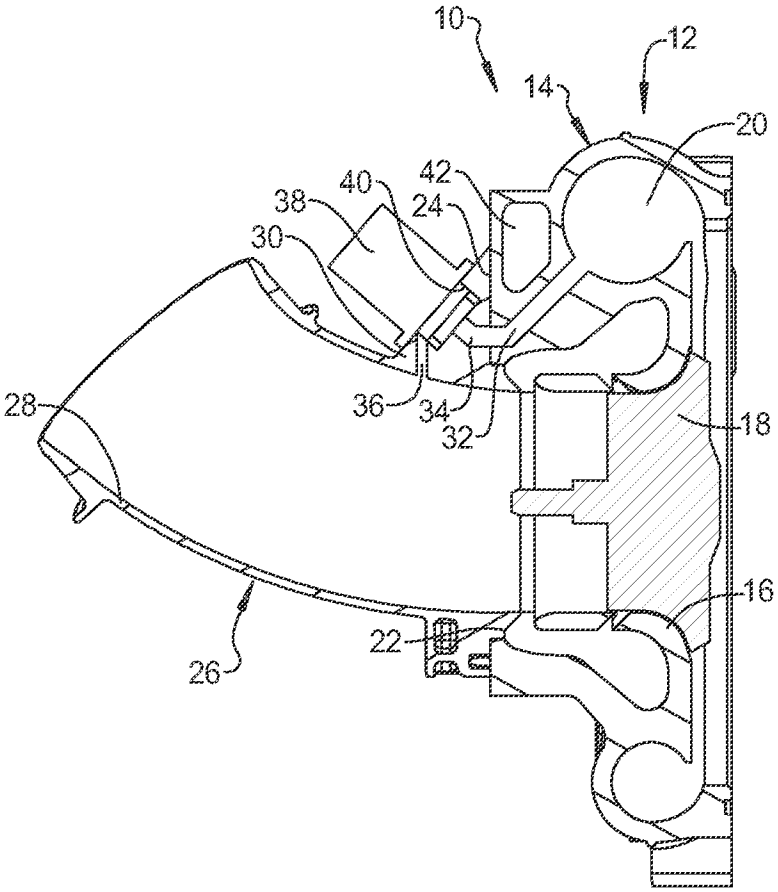
FIG. 2 is a cross-sectional view of a compressor section of a turbocharger according to a second embodiment of the present disclosure.

With reference to FIG. 2, the compressor housing 14 may include a water cooling passage 42 to further reduce heat transfer to the valve 38.

The system of the present disclosure provides a greater range of CRV operability, reduced noise due to CRV operation, and improved sealing at CRV to compressor interface. The system also allows the use of existing commercially available CRV designs versus requiring the use of a custom high temperature valve.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. A compressor system comprising:

a compressor housing including an inlet opening and a diffuser outlet, the compressor housing including a first recirculation passage extending from the diffuser outlet, the compressor housing defining a cavity in communication with the inlet opening and the diffuser outlet;

a compressor wheel disposed in the cavity;

an inlet adapter mounted to the inlet opening of the compressor housing, the inlet adapter including a second recirculation passage in communication with the first recirculation passage in the compressor housing and with a compressor air inlet passage of the inlet adapter, wherein the second recirculation passage extends from a mounting face of the inlet adapter to a surface of the compressor air inlet passage; and a recirculation valve mounted to the inlet adapter and disposed in the second recirculation passage for providing a selective connection of the first recirculation passage to the compressor air inlet passage.

2. The compressor system according to claim 1, wherein the compressor housing includes a coolant passage disposed between the diffuser outlet and the recirculation valve.

3. The compressor system according to claim 1, wherein the compressor housing includes a coolant passage disposed between the diffuser outlet and the inlet adapter.

4. The compressor system according to claim 1, wherein the inlet adapter is made from a plastic material.

5. The compressor system according to claim 4, wherein the plastic material is a Nylon.

6. The compressor system according to claim 1, wherein the first recirculation passage is defined by a bore in the compressor housing extending directly from the diffuser outlet to an exterior face of the compressor housing.

7. The compressor system according to claim 1, wherein the gas recirculation valve is mounted to an exterior of the inlet adapter and in communication with an intermediate portion of the second recirculation passage.

8. A compressor system comprising:

a compressor housing including an inlet opening and a diffuser outlet, the compressor housing including a first recirculation passage extending from the diffuser outlet, the compressor housing defining a cavity in communication with the inlet opening and the diffuser outlet;

a compressor wheel disposed in the cavity;

an inlet adapter made from a plastic material and mounted to the inlet of the compressor housing, the inlet adapter including a second recirculation passage in communication with the first recirculation passage in the compressor housing and with a compressor air inlet passage of the inlet adapter, wherein the second recirculation passage extends from a mounting face of the inlet adapter to a surface of the compressor air inlet passage; and a recirculation valve mounted to the inlet adapter and disposed in the second recirculation passage for providing a selective connection of the first recirculation passage to the compressor air inlet passage.

9. The compressor system according to claim 8, wherein the compressor housing includes a coolant passage disposed between the diffuser outlet and the recirculation valve.

10. The compressor system according to claim 8, wherein the compressor housing includes a coolant passage disposed between the diffuser outlet and the inlet adapter.

11. The compressor system according to claim 8, wherein the plastic material is a Nylon.

12. The compressor system according to claim 8, wherein the first recirculation passage is defined by a bore in the compressor housing extending directly from the diffuser outlet to an exterior face of the compressor housing.

13. The compressor system according to claim 8, wherein the gas recirculation valve is mounted to an exterior of the inlet adapter and in communication with an intermediate portion of the second recirculation passage.

14. A compressor system comprising:

a compressor housing including an inlet opening and a diffuser outlet, the compressor housing including a first recirculation passage extending from the diffuser outlet, the compressor housing defining a cavity;

a compressor wheel disposed in the cavity;

an inlet adapter mounted to the inlet of the compressor housing, the inlet adapter including a second recirculation passage in communication with the first recirculation passage in the compressor housing and with a compressor air inlet passage of the inlet adapter, wherein the compressor housing includes a coolant passage disposed between the diffuser and the inlet adapter, wherein the second recirculation passage extends from a mounting face of the inlet adapter to a surface of the compressor air inlet passage; and a recirculation valve mounted to the inlet adapter and disposed in the second recirculation passage for providing a selective connection of the first recirculation passage to the compressor air inlet passage.

15. The compressor system according to claim 14, wherein the inlet adapter is made from a plastic material.

16. The compressor system according to claim 14, wherein the first recirculation passage is defined by a bore in the compressor housing extending directly from the diffuser outlet to an exterior face of the compressor housing.

17. The compressor system according to claim 14, wherein the gas recirculation valve is mounted to an exterior of the inlet adapter and in communication with an intermediate portion of the second recirculation passage.

* * * * *